US006010231A

United States Patent [19]

Takezawa

[11] Patent Number: 6,010,231

[45] Date of Patent: Jan. 4, 2000

[54] LIGHT SOURCE HOLDING DEVICE

[75] Inventor: Keiji Takezawa, Miyagi-ken, Japan

[73] Assignee: Alps Electric Co., Ltd., Tokyo, Japan

[21] Appl. No.: 08/866,149

[22] Filed: May 30, 1997

[30] Foreign Application Priority Data

Jun. 4, 1996 [JP] Japan ..... 8-141785

[51] Int. Cl.[7] ..... H01R 33/00

[52] U.S. Cl. ..... 362/226; 362/382

[58] Field of Search ..... 362/23, 24, 29, 362/30, 85, 95, 103, 226, 382; 200/310, 313–315, 317

[56] References Cited

U.S. PATENT DOCUMENTS 4,745,530 5/1988 Farrell, Jr. et al. ..... 362/226
4,868,384 9/1989 Franken et al. ..... 362/95
5,087,798 2/1992 Rohde et al. ..... 200/315
5,107,082 4/1992 Valenzona ..... 200/315
5,434,377 7/1995 Martin et al. ..... 200/314
5,513,082 4/1996 Asano ..... 362/226
5,813,519 9/1998 Gotoh ..... 200/313

*Primary Examiner*—Alan Cariaso
*Attorney, Agent, or Firm*—Brinks Hofer Gilson & Lione

[57] ABSTRACT

There is provided a light source holding device for supporting a light source without making the whole device bulky. The light source holding device includes a lamp, a lower case having holding claws projected therefrom to hold the side of the lamp, and a printed circuit board placed above the lower case to receive terminals of the lamp and having a cutout portion at a position opposed to the holding claws in which at least the holding claws are inserted.

2 Claims, 3 Drawing Sheets

LIGHT SOURCE HOLDING DEVICE

BACKGROUND OF THE INVENTION

1. Field of the Invention

The present invention relates to a light source holding device for holding a light source for illumination built in a device such as a dial, a switch or the like.

2. Description of the Related Art

Conventionally, a light source such as a lamp or a light emitting diode is built in various types of devices to indicate a dial or a switch knob. Terminals of such a light source are, as disclosed in, for example, Japanese Unexamined Patent Publication No. 62-293789, usually mounted on a printed circuit board. In this case, a holding member for holding the light source is required to be mounted on the printed circuit board in order to regulate the height of the light source.

Such mounting of the holding member makes the whole device bulkier by the height of the holding member. Furthermore, when a light source is built in a rubber switch device having a rubber portion to illuminate a knob or a display of the rubber switch device, the thickness of the rubber portion is added and the whole switch device is thereby made further bulkier.

SUMMARY OF THE INVENTION

Accordingly, a first object of the present invention is to provide a light source holding device which can hold a light source at a low position relative to a printed circuit board and thereby reduce the height of the whole device.

A second object of the present invention is to provide a light source holding device which can place a light source below the surface of a printed circuit board and thereby further reduce the height of the whole device.

A third object of the present invention is to provide a light source holding device which requires no member for holding a printed circuit board, thereby reduces the number of components and achieves a simple structure.

A fourth object of the present invention is to provide a light source holding device which can achieve bright illumination by mounting even a lengthwise lamp without making the device bulky and by projecting the high intensity light from the side of the lamp.

In order to achieve the first object, according to a first aspect of the invention, a light source holding device comprises a light source, a supporting member having a holding portion projected therefrom to hold the light source, and a printed circuit board placed above the supporting member to receive a terminal of the light source, and having a cutout at a position opposed to the holding portion in which at least the holding portion can be inserted.

In order to achieve the second object, according to a second aspect of the invention, the cutout is large enough to insert at least the light source therein, and the light source is held by the holding portion so that a part of the light source is placed inside the cutout.

In order to solve the third object, according to a third aspect of the invention, the supporting member supports the printed circuit board.

In order to achieve the fourth object, according to a fourth aspect of the invention, the light source is a lamp and at least part of the lamp is placed inside the cutout.

DESCRIPTION OF THE PREFERRED EMBODIMENT

A case in which an embodiment of the present invention is applied to a non-locking rocker switch will be described below as an example with reference to the accompanying drawings.

Figure 1:
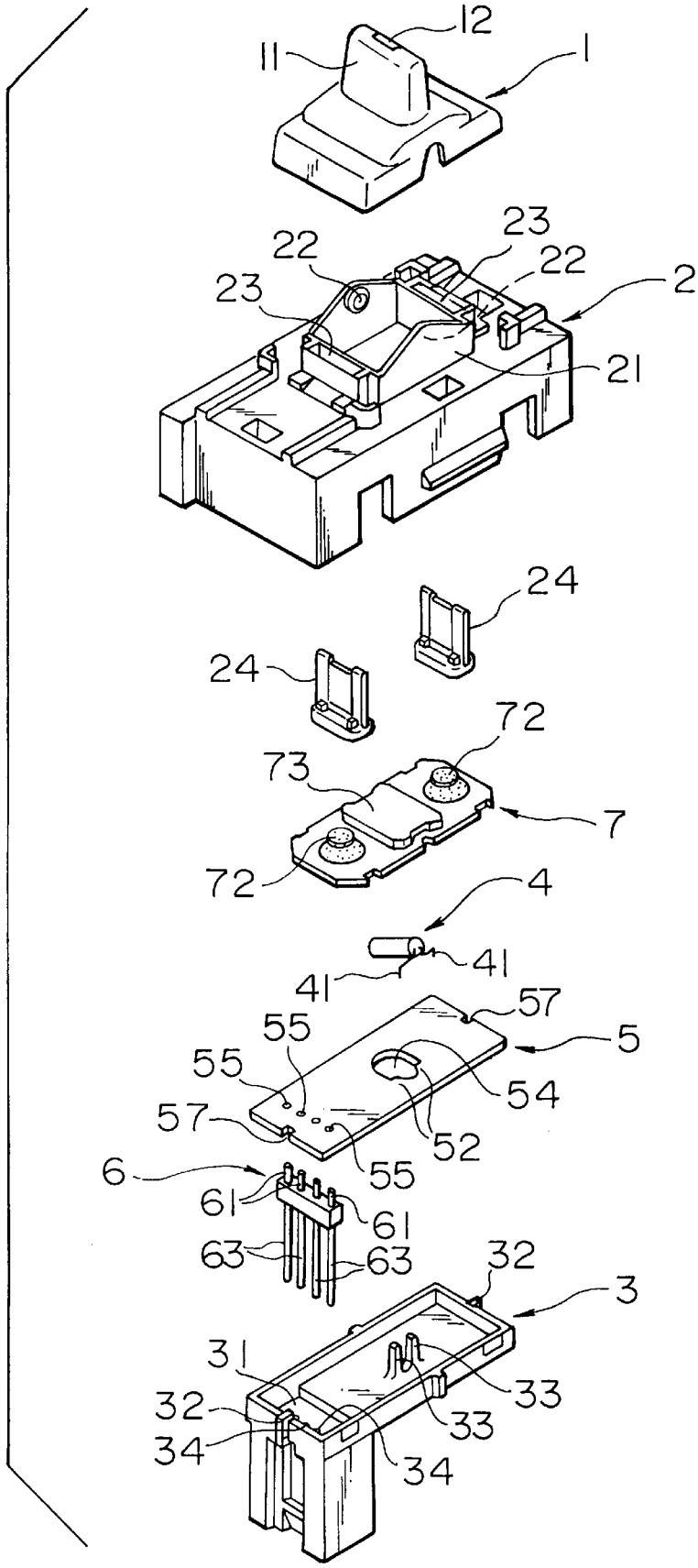
FIG. 1 is an exploded perspective view of a switch device having a light source holding device according to an embodiment of the present invention.
Figure 2:
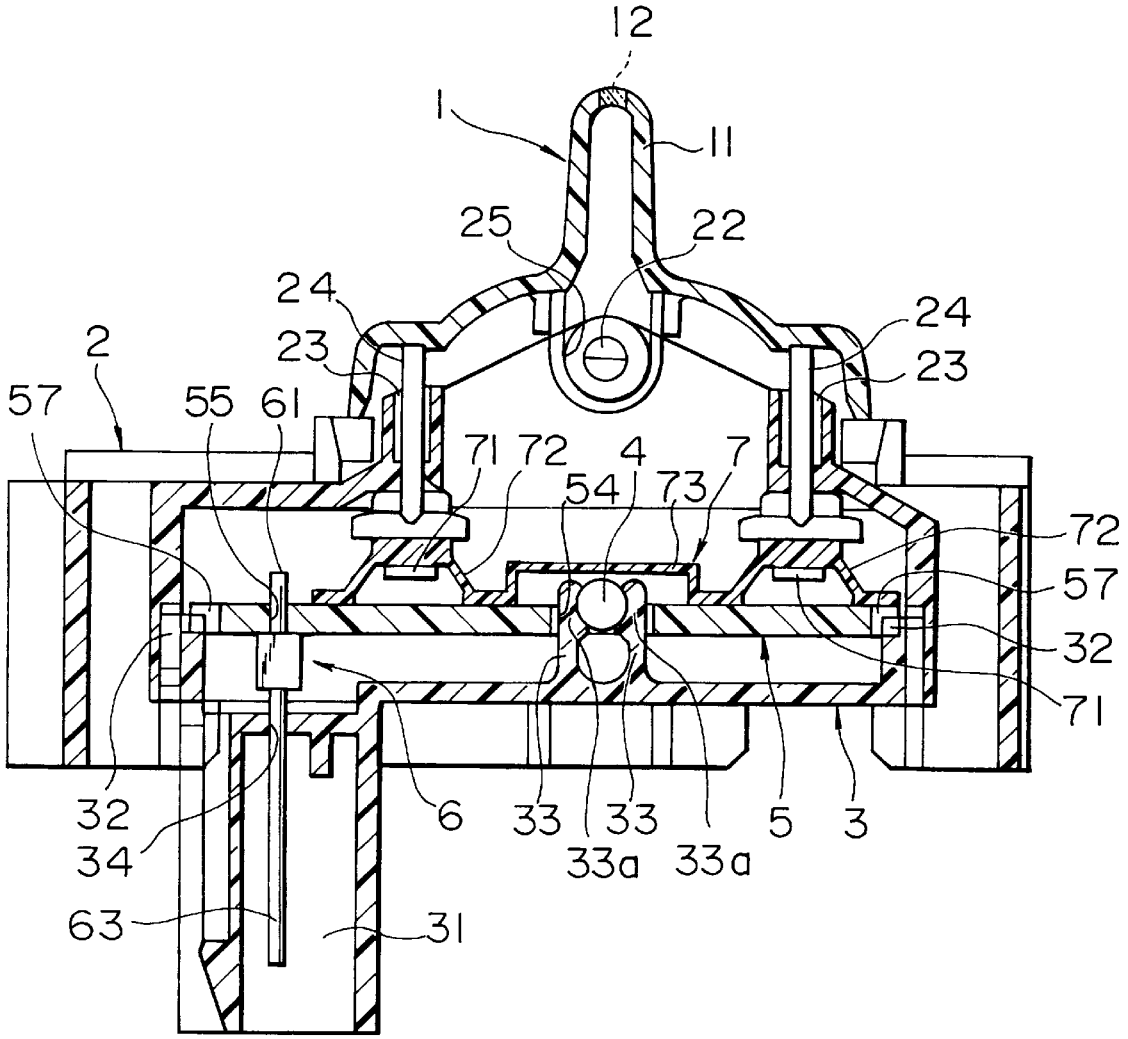
FIG. 2 is a longitudinal sectional view of the switch device.
Figure 3:
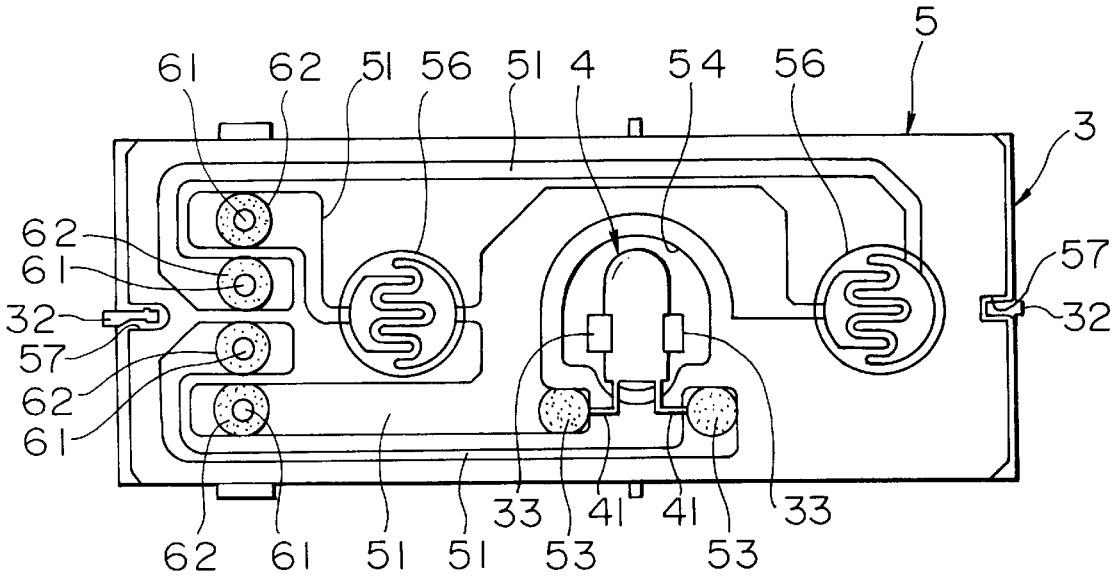
FIG. 3 is a plan view of a printed circuit board in the switch device.

FIG. 1 is an exploded perspective view of a switch device having a light source holding device according to the embodiment of the present invention, FIG. 2 is a longitudinal sectional view of the switch device, and FIG. 3 is a plan view of a printed circuit board in the switch device.

The switch device is contained in a housing formed by an upper case 2 for supporting a knob 1 pivotally thereon and a lower case 3 to be fitted in the lower portion of the upper case 2. This lower case 3 corresponds to a supporting member.

The knob 1 is provided with a boss 11 to be pivoted by being pushed with a finger at the center portion thereof. In the center of the boss 11, a light transmitting portion 12 made of a transparent or translucent light transmitting material, such as acrylic, is formed to transmit the light therethrough.

A square enclosure 21 is formed on almost the center of the upper surface of the upper case 2, and pivoting projections 22 project almost horizontally from a pair of opposed inner walls of the enclosure 21.

These pivoting projections 22 are, as shown in FIG. 2, pivotally fitted in retaining holes 25 formed integrally with opposed surfaces in the rear center of the knob 1, respectively. Slots 23 are respectively formed vertically through the other pair of opposed inner walls of the enclosure 21. Cams 24 are respectively inserted in the pair of slots 23 to be pushed down in correlation to the pivotal motion of the knob 1.

A printed circuit board 5 is laid on the lower case 3. As shown in FIGS. 1 and 3, electrically conductive pathways 51 for illumination of a lamp 4 and for a switch circuit are formed on this printed circuit board 5, and terminals 41 of the lamp 4 are respectively inserted in terminal holes 52 of the conductive pathway for illumination and fixed by solder 53. A cutout portion 54, into which the lamp 4 can be inserted in the horizontal position, is formed adjacent to the terminal holes 52 of the printed circuit board 5 as shown in FIG. 1.

Terminal holes 55 of the conductive pathways are formed at one end of the printed circuit board 5, and terminals 61 of a connector 6 supported by a connector supporting portion 31 of the lower case 3 are inserted in the terminal holes 55 and fixed by solder 62, respectively. Two fixed contacts 56 are mounted on the printed circuit board 5 to sandwich the cutout portion 54. The solder 62 connects the terminals 61 of the connector 6 to a land of the printed circuit board 5.

When the printed circuit board 5 is mounted on the lower case 3, positioning bosses 32 of the lower case 3 are respectively inserted in positioning notches 57, thereby holding the printed circuit board 5 on the lower case 3 in a predetermined position.

A rubber contact mat 7 capable of transmitting the light is laid on the printed circuit board 5. As shown in FIG. 2, this rubber contact mat 7 has two movable contacts 71 placed over the fixed contacts 56 of the printed circuit board 5. The movable contacts 71 are respectively mounted on the inner sides of the tops of elastic convex portions 72 projecting upward. Lower ends of the cams 24 are respectively in contact with the elastic convex portions 72. Between the elastic convex portions 72, a light transmitting portion 73 is formed to cover the lamp 4 and project the light from the lamp 4 upward therethrough.

The lower case 3 supports the printed circuit board 5, and has a pair of elastic holding claws 33 formed integrally thereon to hold the lamp 4 at a predetermined height. The holding claws 33 are respectively provided with holding portions 33*a* having recesses to fit the outer periphery of the lamp 4. The holding portions 33*a* are arranged to be placed in the cutout portion 54 of the printed circuit board 5 when the printed circuit board 5 is mounted on the lower case 3, whereby the outer periphery of the lamp 4 placed in the horizontal position is elastically nipped by the holding portions 33*a*. Numeral 34 denotes through holes in which external connecting terminals 63 of the connector 6 are inserted.

Though the leading end of the holding claw 33 projects a little above the upper surface of the printed circuit board 5 through the cutout portion 54 as shown in FIG. 2 in this embodiment, the position of the holding claw 33 may be appropriately changed in accordance with a desired height of the lamp 4.

In assembling the switch thus constructed, the lower case 3 is first fixed on a jig (not illustrated) like a soldering table, and the connector 6 is mounted in the connector holding portion 31 by inserting the external connecting terminals 63 into the through holes 34.

Next, the printed circuit board 5 is laid on the lower case 3 by inserting the terminals 61 of the connector 6 into the terminal holes 55. Then, the terminals 41 of the lamp 4, which are extended from the bottom of the lamp 4 and previously bent at almost the right angle as shown in FIG. 1, are fitted into the terminal holes 52 of the printed circuit board 5. The lamp 4 is thereby placed in the horizontal position inside the cutout portion 54, and the side thereof is snapped in and held by the holding claws 33. Finally, the terminals 41 of the lamp 4 and the terminals 61 of the connector 6 are soldered on the printed circuit board 5. The switch device is assembled in such a simple process.

Since the light of the lamp 4 is projected out from the light transmitting portion 73 of the rubber contact mat 7 and the light transmitting portion 12 formed on the boss 11 of the knob 1 in this switch device, the position of the knob 1 can be found even in a dark place.

As mentioned above, since the lamp 4 is held by the holding claws 33 placed inside the cutout portion 54 of the printed circuit board 5 and the cutout portion 54 is large enough to house or insert the lamp 4, which is placed in the horizontal position, therein, it is possible to hold the lamp 4 at an arbitrary height in a wide range of heights from below to above the printed circuit board 5 regardless of the thickness of the printed circuit board 5 by changing the height of the holding claws 33. Therefore, in order to limit the height of the switch device, the lamp 4 is held at a low position.

The intensity of light of the lengthwise lamp used in this embodiment is usually higher on the side than on the top of the lamp. Therefore, efficient light emission can be achieved by placing the lamp in the horizontal position as mentioned above.

Though the holding of the lamp in the switch device is described in the above embodiment, the present invention is applicable not only to the holding of a light source for illuminating a control knob or panel of an electric or electronic device, but also to the holding of a light source for illuminating a control knob or panel of a vehicle. Furthermore, it is needless to say that other light sources than the lamp, such as a light emitting diode (LED), may be used.

According to the invention of claim 1, it is possible to hold a light source at a low position relative to a printed circuit board and thereby reduce the height of the whole device.

According to the invention of claim 2, it is possible to place a light source below the surface of a printed circuit board and to thereby further reduce the height of the whole device.

According to the invention of claim 3, no member for holding the printed circuit board is needed, and therefore, it is possible to reduce the number of components and achieve a simple structure.

According to the invention of claim 4, since even a lengthwise lamp can be mounted without making the device bulky and the light of high intensity from the side of the lamp can be projected, bright illumination can be achieved.

What is claimed is:

1. A light source holding device, comprising:

a light source, wherein said light source is a lamp;

a supporting member having a holding portion projected therefrom to hold said lamp; and a printed circuit board placed above said supporting member to receive a terminal of said lamp, and having a cutout at a position opposed to said holding portion in which at least said holding portion is capable of being inserted;

and whereby said lamp is inserted in the horizontal position into said cutout and at least part of said lamp is placed inside said cutout.

2. A light source holding device according to claim 1, wherein said supporting member supports said printed circuit board.

* * * * *